US005175389A

United States Patent [19]

Kramer et al.

[11] Patent Number: 5,175,389

[45] Date of Patent: Dec. 29, 1992

[54] FRONTALLY GUIDED SABOT BULLET

[75] Inventors: Robert L. Kramer, Minneapolis; David C. Longren, Maple Grove; Jerry J. Rubatt, Coon Rapids, all of Minn.

[73] Assignee: Federal-Hoffman, Inc. d/b/a Federal Cartridge Co., Anoka, Minn.

[21] Appl. No.: 817,732

[22] Filed: Jan. 7, 1992

[51] Int. Cl.[5] ..... F42B 14/06

[52] U.S. Cl. ..... 102/521; 102/509

[58] Field of Search ..... 102/520–523, 102/508, 509

[56] References Cited

U.S. PATENT DOCUMENTS

| | | | |
|---|---|---|---|
| 39,930 | 9/1863 | Jenks | 102/522 |
| 195,040 | 9/1877 | Owen | 102/522 |
| 2,573,362 | 10/1951 | Rouse | 102/520 |
| 3,141,412 | 7/1964 | Roehrdanz | 102/522 |
| 3,311,061 | 3/1967 | Roehrdanz | 102/522 |
| 3,613,584 | 10/1971 | Hendricks | 102/520 |
| 3,726,231 | 4/1973 | Kelly et al. | 102/520 |
| 3,762,332 | 10/1973 | Witherspoon et al. | 102/523 |
| 3,771,458 | 11/1973 | Schweimler et al. | 102/523 |
| 3,881,421 | 5/1975 | Burczynski | 102/509 |
| 3,927,618 | 12/1975 | Engel | 102/523 |
| 4,413,565 | 11/1983 | Mathey et al. | 102/520 |
| 4,476,785 | 10/1984 | Hoffman et al. | 102/522 |
| 4,550,662 | 11/1985 | Burczynski | 102/509 |
| 4,644,866 | 2/1987 | Sullivan | 102/520 |
| 4,700,630 | 10/1987 | Sullivan | 102/520 |
| 4,829,904 | 5/1989 | Sullivan | 102/520 |
| 4,836,110 | 6/1989 | Burczynski | 102/508 |
| 4,882,822 | 11/1989 | Burczynski | 102/506 |
| 4,947,755 | 8/1990 | Burczynski | 102/506 |
| 5,012,744 | 5/1991 | Sowash | 102/523 |
| 5,014,624 | 5/1991 | Baxter et al. | 102/520 |
| 5,016,538 | 5/1991 | Sowash | 102/520 |

FOREIGN PATENT DOCUMENTS

| | | |
|---|---|---|
| 4426 | of 1899 | United Kingdom . |
| 14717 | 3/1900 | United Kingdom . |

OTHER PUBLICATIONS

"Shotgun Slugs" by Robert W. Hunnicutt, American Rifleman Nov. 1991, pp. 46–51, 81, 82, 86, 90 and 92.

*Primary Examiner*—Harold J. Tudor

*Attorney, Agent, or Firm*—Schroeder & Siegfried

[57] ABSTRACT

An improved sabot bullet for use primarily in connection with shotgun shells which includes a slug having a forward portion which radially converges towards the middle portion thereof, and an outer conforming sabot casing which includes a pair of sabot segments which substantially surround and conform to the outer configuration of the slug. Each sabot segment is constructed to be slightly radially spaced from the slug near the constricted middle portion thereof, and to converge and engage the radially diverging portion of the slug near the forward end thereof, so as to cause the slug to be guided mainly at a point adjacent the front end thereof. Each sabot segment is also constructed to extend rearwardly beyond the rear end of the slug to facilitate rearward movement of the slug relative to the sabot, and consequent outward radial wedging of the sabot segments against the inner walls of the gun barrel, upon firing the fireman.

19 Claims, 2 Drawing Sheets

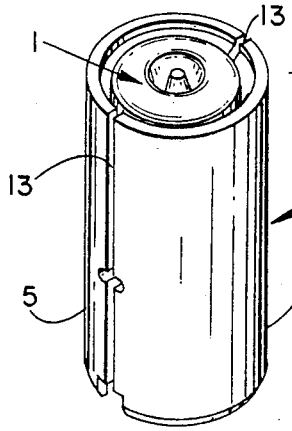
Fig.-1
Fig.-3
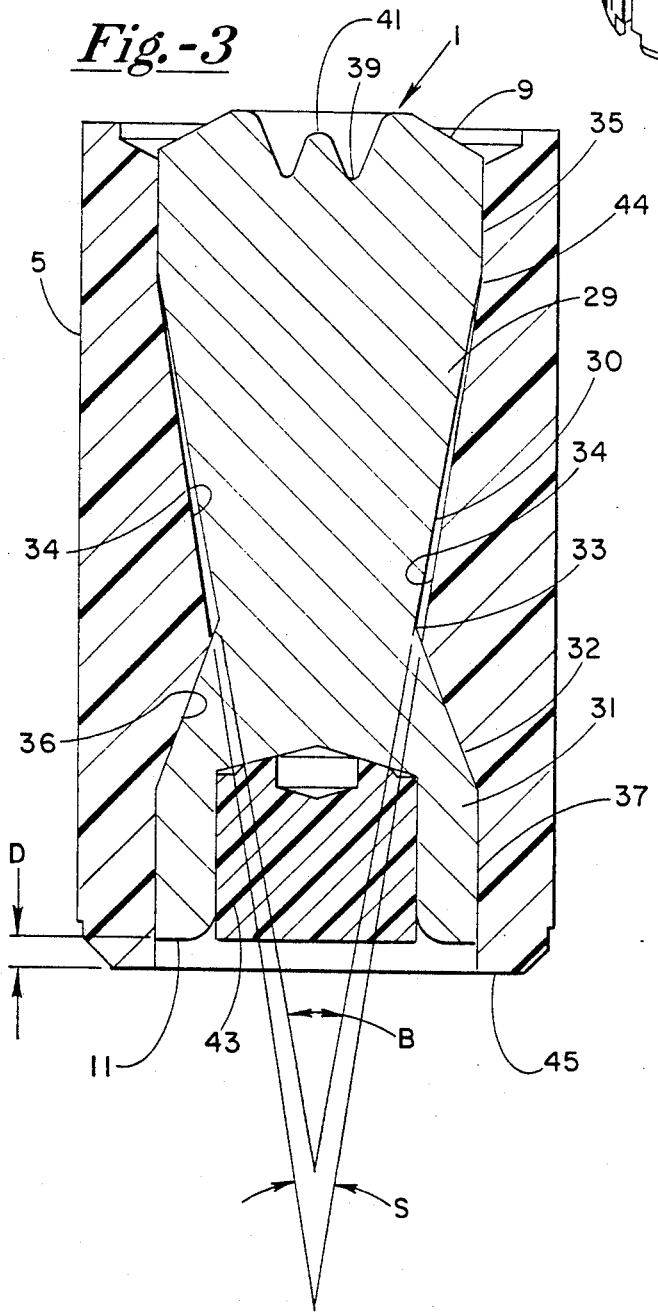
Fig.-2
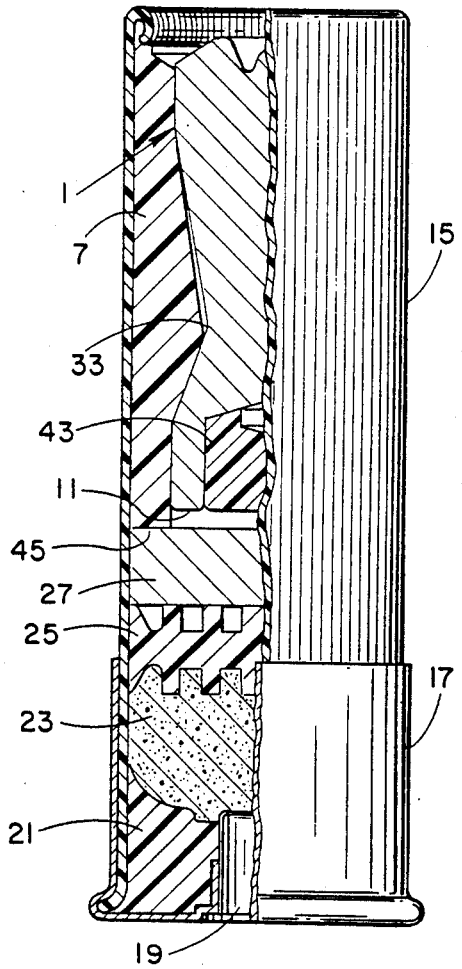

FRONTALLY GUIDED SABOT BULLET

BACKGROUND OF THE INVENTION

The instant invention is related generally to the use of sabots for guiding sub-caliber projectiles through the barrel of a firearm, and is more specifically directed to an improved sabot bullet or slug for use in connection with shotguns.

Sabot bullets for loading within shotgun shells have heretofore been known, as shown in U.S. Pat. No. 3,726,231, which issued to Kelly et al on Apr. 10, 1973. The above patent discusses the problems associated with providing a sabot bullet for use with a shotgun, and the necessity for the sabot to expand to meet the varying barrel diameters of various shotguns in order to properly guide the bullet therethrough. Although these problems are acknowledged in the above patent, the means employed for solving the same have been found to be inadequate.

With a sabot bullet of the type described in the above patent, proper bullet guidance through a gun barrel depends in large part upon proper spreading of the sabot within the barrel and consequent centering of the bullet guided thereby. In order for the sabot segments to spread and engage the inner walls of a shotgun barrel while maintaining a snug guiding engagement with the bullet, it is necessary that there be rearward movement of the bullet relative to the sabot segments, so as to wedge the sabot segments outwardly against the barrel walls. Without adequate movement between the bullet and sabot, and consequent expansion of the sabot segments, the bullet will not be properly centered in the bore of the shotgun barrel, thereby diminishing the accuracy of the bullet.

The problem with the design of conventional sabot bullets, as shown in the above patent, is that there is little or no allowance provided in the construction of such bullets to allow the necessary relative movement between the bullet and sabot. As can be seen from the sabot bullet in the above patent, the bullet and sabot segments are all initially in abutment with the card wad. Upon firing a shotgun, the direct force of the propellent is applied to the card wad which, in turn, propels the sabot and bullet down the length of the barrel. Since the wad is in initial abutment with both the sabot and the bullet, there can be little or no relative movement between such parts. Consequently, any expansion of the sabot segments is inadequate, if present at all.

Another problem associated with conventional sabot bullets of the type disclosed in the above patent, is that the sabot segments are designed to be in close-conforming, tight-fitting relation with the outer confines of the bullet surrounded thereby. The driving force of the propellent is transfered through the sabot and distributed randomly throughout the entire length of the forward radially diverging portions of the bullet depending on the angular lockup between the sabot and bullet surrounded thereby. The spreading of such forces randomly over a major portion of the bullet surface allows more chance for improper alignment and inbore tipping of the bullet, depending on where the bullet/sabot bearing surface loading takes place. It has been found that the distribution of such forces along the entire forward diverging surface of the bullet is undesirable in that it can provide guidance for the bullet at a point more rearward than desirable, and causes inaccuracies in the flight pattern thereof due to tipping of the bullet in the bore and consequent yaw in flight.

From the above, it is evident that it is desirous to guide the bullet through the barrel of a shotgun from a point near the forward end thereof while simultaneously providing the necessary relative movement between the bullet and sabot segments to provide adequate spreading and wedging of the sabot segments against the inner walls of the shotgun barrel. The instant invention provides an unique construction which meets the above objectives and overcomes the deficiencies previously noted with respect to conventional sabot bullets.

BRIEF SUMMARY OF THE INVENTION

The instant invention addresses the above problems related to proper bullet guidance and solves the deficiencies of conventional sabot bullets by utilizing a complimentary sabot and bullet structure which facilitates significant rearward movement of the bullet relative to the sabot, and consequent wedging of the sabot segments against the inner walls of the shotgun barrel. The design of the instant invention also provides drivable engagement of the bullet by the sabot segments mainly at a point adjacent the forwardmost portion of the bullet, thereby enhancing the accuracy of the bullet as it leaves the barrel of the shotgun.

In accordance with the present invention, the bullet structure or slug is comprised of a generally cylindrical mass of lead, or other suitable material, which includes a forward frustro-conically shaped portion and a rearward frustro-conically shaped portion which converge to form a radially constricted middle portion. From the radially constricted middle portion, the outer circumferential surface of the bullet diverges radially outward toward the forward and rearward ends of the bullet leaving only a relatively short, substantially cylindrical portion at each end.

The sabot substantially surrounds the intermediate portion of the bullet between opposite ends thereof and provides an outer cylindrical housing which guides the bullet through the barrel of the shotgun. The sabot comprises a pair of generally semi-cylindrical sabot segments with complimentary inner surface configurations which conform substantially to the outer configuration of the bullet. Such sabot segments wrap around the body of the bullet to form the outer generally cylindrical housing which guides the bullet.

Each sabot segment is preferably constructed of a plastic material and designed such that the conforming inner surface configuration thereof is slightly radially spaced from the outer surface configuration of the bullet throughout the major portion of the bullets forward radially diverging circumferential surface. Each of the sabot segments drivably engage the bullet in guiding relation mainly at a point adjacent the forwardmost portion of the radially diverging forward portion of the bullet.

From the point of drivable engagement between the sabot segments and the forward portion of the bullet, the outer frustro-conically shaped portion of the bullet structure, and the conforming inner surface configuration of each sabot segment, converge toward the radially constricted middle portion of the bullet (or diverge outwardly therefrom) at slightly different angles. The angle of convergence/divergence formed by the inner surface configuration of the sabot segments is less than the angle of convergence/divergence formed by the outer frustro-conically shaped forward portion of the bullet. By reason thereof, the inner surface configuration of each sabot segment becomes increasingly radially spaced from the body of the bullet as it approaches the radially constricted mid-portion thereof.

Throughout the body of this specification, including the appended claims, reference is made to the angle of divergence and/or convergence of either the outer bullet configuration or inner surface configuration of the sabot segments. Any such reference is intended to be directed to the relative angles formed by the convergence toward, or divergence away, of the referenced configuration, from the radially restricted middle portion of the bullet. Such angles are shown for illustration purposes in FIG. 3 of the accompanying drawings.

Because of such spacing between the bullet and the sabot segments, upon firing the shotgun, the forces of the propellent are transmitted through each sabot segment mainly to the forwardmost portion of the forward radially diverging surface of the bullet, thereby drivably engaging the same in guiding relation through the barrel of the shotgun. As stated previously, guiding the bullet structure from a point closely adjacent the front end thereof has been found to significantly improve the accuracy of the bullet's flight pattern.

To further enhance proper guidance of the bullet structure through the barrel of the shotgun, each sabot segment is designed to extend rearwardly beyond the rear end of the bullet structure, so as to facilitate and enhance the desired rearward movement of the bullet structure relative to the sabot segments upon firing the shotgun. The initial force of the propellent against the card wad is transferred into the rearwardly extending portion of each sabot segment, and therethrough to the forwardmost portion of the forward radially diverging surface of the bullet structure. As a consequence of the setback forces, the bullet structure is caused to move rearward relative to the sabot segments, toward the card wad, thereby causing each sabot segment to spread and wedge outwardly against the inner walls of the shotgun barrel.

The enhanced wedging action of the sabot through the shotgun barrel, and the guidance of the bullet structure mainly from a point near the front end thereof, results in a marked improvement in the accuracy of the flight pattern of the bullet once it leaves the barrel. Of course, upon leaving the barrel, each sabot segment separates from the bullet and allows the bullet to travel to its target without further contact therewith.

BRIEF DESCRIPTION OF THE DRAWINGS

FIG. 1 is a perspective view of our improved frontally guided sabot bullet.

FIG. 2 is a partial vertical sectional view of a shotgun shell into which our improved frontally guided sabot bullet is mounted.

FIG. 3 is a sectional view of our frontally guided sabot bullet, showing the construction of the sabot and bullet and the relationship therebetween when assembled.

DETAILED DESCRIPTION OF THE DRAWINGS

Figure 4:
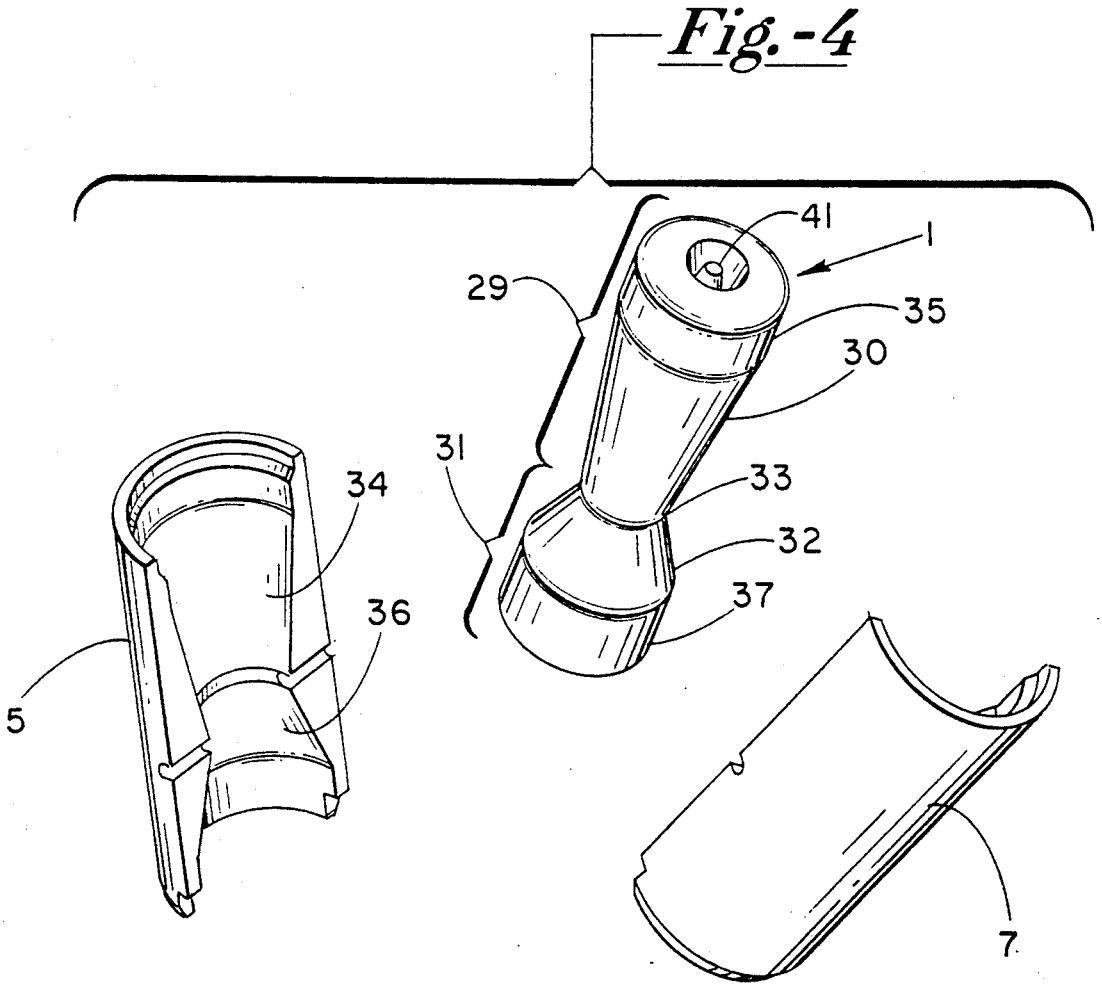
FIG. 4 is a perspective view of our frontally guided sabot bullet after it has left the shotgun barrel, showing the sabot segments falling away from the bullet.

As shown in FIG. 1, our improved sabot bullet comprises a bullet structure or slug 1 which is substantially surrounded by sabot 3, which is comprised of a pair of generally semi-cylindrical sabot segments 5 and 7. Sabot segments 5 and 7 are constructed to substantially surround the intermediate portion of bullet structure 1 between respective opposite forward and rearward ends, 9 and 11, thereof. Each sabot segment 5 and 7 is constructed to wrap around approximately one-half of the bullet structure, leaving only a small spacing 13 between said sabot segments when assembled around the bullet structure 1. Spacing 13 on either side of the sabot bullet essentially provides a manufacturing tolerance to ensure that sabot segments 5 and 7 are disposed in guiding contact with bullet 1 upon assembly thereof within shotgun casing 15, and to maintain this relationship while traveling through the shotgun barrel. Preferably, bullet 1 is constructed from lead or steel, and sabot segments 5 and 7 are constructed from a suitable plastic material.

As shown best in FIG. 2, an assembled shotshell casing 15 includes a primer 19 which is held in exposed relation by head 17 thereof. Securely packed around the primer 19 is a base wad 21, and superimposed immediately above the primer is the shotshell propellent 23. Superimposed over propellent 23 is over powder wad 25 and card wad 27, which propel the sabot 3 and bullet 1 through the barrel of the shotgun upon firing of the same. In a conventional manner, upon firing the shotgun, the primer 19 ignites the propellent 23 which, in turn, propels over powder wad 25, card wad 27 and the sabot bullet through the barrel of the shotgun.

As seen in FIGS. 2 and 3, bullet structure 1 has a generally frustro-conically shaped forward portion 29 and a generally frustro-conically shaped rearward portion 31 which converge to define a radially constricted middle portion 33. The general frustro-conically shaped forward portion 29 includes a radially diverging outer circumferential surface 30 which begins at middle portion 33 and terminates at the foremost cylindrically shaped end portion 35 of the forward portion of bullet 1. Similarily, the rearward generally frustro-conically shaped portion 31 of bullet 1 includes a radially diverging outer circumferential surface 32 which begins at middle portion 33 and terminates at the rearmost cylindrically shaped end portion 37 thereof.

The construction of the front end 9 of bullet 1 is that of a conventional hollow-point type, which includes a central annular cavity 39 with a raised center post 41 extending outwardly from the base of cavity 39 along the central longitudinal axis thereof. The hollow-point type construction of bullet 1 allows for maximum spread of front end 9 upon striking its target.

The central portion of rear end 11 of bullet 1 is hollowed out to form an enlarged cavity into which a plastic plug 43 is inserted and carried in secure relation. Plastic plug 43 effectively shifts the center of gravity of bullet 1 to the forward portion 29 thereof, which is desirable to improve the accuracy of the bullet and to guide the bullet at a point closely adjacent thereto.

As shown in FIGS. 2 and 3, each sabot segment 5 and 7 have an outer substantially semi-cylindrical configuration, and an inner configuration which conforms substantially to the outer surface configuration of bullet 1. More specifically, as can be seen best in FIG. 3, each sabot segment 5 and 7 have complimentary diverging inner surface configurations 34 and 36 which conform substantially to the outer radially diverging surface configurations 30 and 32 of bullet 1, respectively. With respect to the rearward portion 31 of bullet 1, the rear inner surface configuration of each sabot segment 5 and 7 is designed to be disposed in engaging relation therewith. However, with respect to the forward portion 29 of bullet 1, the complimentary forward inner surface configuration 34 which extends adjacent thereto is designed so as to preferably be slightly radially spaced from bullet 1 along a substantial portion of the forward radially diverging outer circumferential surface 30 thereof.

As can be seen in FIG. 3, the radial spacing between sabot segments 5 and 7 and bullet 1 is greatest near middle portion 33 of bullet 1, and becomes less as it approaches the intersection of said radially diverging surface 30 and the foremost cylindrical end portion 35 thereof. Each sabot segment 5 and 7 is designed to drivably engage the forwardmost sabot bearing surface portion of the forward radially diverging surface 30 of bullet 1 at approximately point 44, which is immediately adjacent the foremost front end portion 35 of the same.

As indicated throughout the specification, and in the appended claims, the forward portion of bullet 1, and the complimentary conforming inner surface configurations of sabot segments 5 and 7, can be viewed as having radially inwardly tapering portions 30 and 34 which converge from a point adjacent front end 9 of bullet 1 toward the radially constricted middle portion 33 thereof. Such tapering surfaces 30 and 34 may also be viewed as diverging from radially constricted portion 33 toward a point adjacent the front end 9 of bullet 1.

If one extends the tangential lines (shown in FIG. 3) of the forward inwardly tapering surfaces 30 of bullet 1, and of the complimentary inner surface configuration 34 of sabot segments 5 and 7, such lines form angles of convergence (or divergence), labeled as angle "B" and angle "S", respectively. Although exaggerated for illustrative purposes, it can be seen from FIG. 3 that angle S is necessarily slightly less than angle B, thereby causing the inner surface configuration of each sabot segment 5 and 7 to be radially spaced from a substantial portion of the forward radially diverging surface 30 of bullet 1. Each sabot segment 5 and 7 drivably engages bullet structure 1 in guiding relation near point 44 on the radially diverging surface 30 of forward portion 29 of bullet 1. Preferably, angle S lies within the approximate range of 19 to 20 degrees, and angle B falls within the range of 20 to 21 degrees.

Constructing each sabot segment so as to be radially spaced from a substantial portion of the radially diverging surface 30 of the bullet's forward portion 29 causes such sabot segments to only contact the bullet structure 1 in drivable engagement at a single point along the length thereof. By concentrating the drivable engagement and guidance of each sabot segment at a single point along the forward diverging portion 30 of bullet 1 diminishes the chance and likelihood of other forces being exerted on the body of the bullet 1 and causing disruption in the flight pattern of the same. As such, the drivable engagement and guidance of bullet 1 is concentrated near a single point 44 closely adjacent to the front end 9 of bullet 1, thereby enhancing the accuracy of the flight pattern of bullet 1 as it leaves the shotgun barrel.

To further enhance proper guidance of bullet 1 through the barrel of a shotgun, the rear portion 45 of each sabot segment 5 and 7 extends rearwardly of the rear end 11 of bullet 1 a short distance designated as "D" in FIG. 3. As can be seen best in FIG. 2, by providing an axially spaced relation between rear end 45 of each sabot segment 5 and 7, and rear end 11 of bullet 1, the card wad 27, which propels the sabot bullet through the barrel of the shotgun, is initially in direct engagement only with the rear end 45 of each sabot segment 5 and 7.

Upon firing the shotgun, the initial force of the propellent 23 will be transmitted through sabot segments 5 and 7 and into bullet 1 near point 44 so as to drivably engage the same. However, setback forces caused by the ignition of the propellent 23, and the weight of bullet 1, tends to urge bullet 1 rearwardly relative to sabot segments 5 and 7. Because of the spacing D between bullet 1 and card wad 27, which propels the same through the barrel of the shotgun, bullet 1 is allowed to move rearwardly relative to such sabot segments 5 and 7 a maximum distance of D. Preferably, the spacing D is approximately 0.045 inches. As bullet 1 moves rearwardly relative to sabot segments 5 and 7, such segments are wedged outwardly against the inner surface of the shotgun barrel thereby causing bullet structure 1 to be continually engaged by sabot segments 5 and 7 in guiding relation at the approximate point 44 until the sabot bullet leaves the end of the barrel.

As shown in FIG. 4, once the sabot bullet leaves the end of the barrel, the air impingement upon the front end of bullet 1 and upon sabot segments 5 and 7, causes the sabot segments to readily release from bullet 1 without further contact therewith. Bullet 1 is then allowed to travel with a high degree of accuracy toward its target. By designing our improved sabot bullet to allow greater movement of the bullet 1 relative to the sabot segments, greater expansion of such sabot segments is allowed which provides better centering of bullet 1 within the shotgun barrel. By providing a sabot structure which drivably engages the bullet in guiding relation mainly at a point closely adjacent to the front end thereof has also provided enhanced accuracy in the flight pattern of the bullet. The resulting sabot bullet is more stable as it passes through and exits the barrel of a shotgun, which causes greatly improved accuracy in the flight pattern thereof.

It will, of course, be understood that various changes may be made in the form, details, arrangement and proportions of the parts without departing from the scope of the invention which comprises the matter shown and described herein and set forth in the appended claims.

We claim:

1. A sabot bullet to be employed within a shotgun shell for use with a firearm, comprising:

(a) an integral bullet structure having an outer surface configuration defined by a generally frustro-conically shaped forward portion and a generally frustro-conically shaped rearward portion which converge to form a radially constricted middle portion between opposite forward and rear ends thereof;

(b) a plurality of sabot segments substantially surrounding at least an intermediate portion of said bullet structure between said opposite forward and rear ends thereof, each of said sabot segments having complimentary forward and rearward inner surface portions with forward and rearward inner surface configurations which conform substantially to said outer surface configuration of said bullet structure;

(c) each of said sabot segments extending rearwardly beyond said rear end of said bullet structure, and being constructed with means for facilitating rearward movement of said bullet structure relative to said sabot segments and consequent wedging of said sabot segments outwardly against the barrel of the firearm upon firing thereof; and (d) a substantial portion of said forward inner surface configuration of each of said sabot segments being disposed in non-registering relation with said forward portion of said bullet structure so as to define an annular gap therearound adjacent said constricted middle portion thereof, each of said sabot segments drivably engaging said bullet structure in guiding relation mainly at a point adjacent to said forward end thereof upon firing of the firearm.

2. The structure defined in claim 1, wherein said forward inner surface portion of each sabot segment is slightly radially spaced from the outer surface of said bullet structure at a point adjacent said constricted middle portion thereof, said forward inner surface portion of each said sabot segment diverging outwardly therefrom toward said forward portion of said bullet structure and engaging said bullet structure near the forward end thereof.

3. The structure defined in claim 2, wherein the angle of divergence of said frustro-conically shaped forward portion of said bullet structure from its said radially constricted middle portion toward said forward end thereof is within an approximate range of 20 to 21 degrees, and the angle of divergence of said corresponding forward inner surface configuration of each of said sabot segments is in the approximate range of 19 to 20 degrees.

4. The structure defined in claim 1, wherein said forward frustro-conically shaped portion of said bullet structure converges from a point near said forward end toward said radially restricted middle portion at a slightly greater angle than said conforming forward inner surface configuration of each of said sabot segments, thereby causing said sabot segments to be slightly radially spaced from said bullet structure along a substantial portion of said frustro-conically shaped forward portion thereof.

5. The structure defined in claim 1, wherein said forward end of said bullet structure has a centrally disposed anular cavity extending axially toward said rear end thereof with an axially raised center post extending forwardly from the base of said cavity.

6. The structure defined in claim 1, wherein each of said sabot segments extends rearwardly approximately 0.045 inches further than the rear end of said bullet structure.

7. The structure defined in claim 1, wherein the center of gravity of said bullet structure is located within said forward portion thereof.

8. The structure defined in claim 7, wherein said rear end of said bullet structure has an enlarged cavity therein within which a plastic plug is securely carried.

9. A sabot bullet to be employed within a shotgun shell for use with a firearm, comprising:

(a) an integral bullet structure having a front end and a rear end with an elongated intermediate portion therebetween, said bullet structure having an outer configuration which is generally cylindrical in shape with a radially constricted middle portion, said outer configuration of said bullet structure diverging outwardly from said radially constricted middle portion towards said front end thereof to define a sabot bearing surface;

(b) a sabot means primarily for guiding said bullet structure through the barrel of the firearm, said sabot means comprising a plurality of sabot segments which cooperate to substantially surround said outer configuration of at lest said intermediate portion of said bullet structure in substantially close conforming relation therewith, each of said sabot segments being radially spaced annularly about the outer surface of said bullet structure at a point adjacent said constricted middle portion thereof, and diverging outwardly therefrom toward the front end of said bullet structure; and (c) each of said sabot segments propellably engaging said sabot bearing surface of said bullet structure in guiding relation mainly at a point near the front end thereof upon firing of the firearm.

10. The structure defined in claim 9, wherein said bullet structure has a frustro-conically shaped forward portion, said corresponding conforming portions of said sabot segments engaging said bullet structure along said frustro-conically shaped forward portion at a point adjacent said front end of said bullet structure.

11. The structure defined in claim 9, wherein said bullet structure has a substantially cylindrical front end portion disposed forwardly of said sabot bearing surface, said corresponding conforming portions of said sabot segments being slightly radially spaced annularly about a substantial portion of said outwardly diverging portions of said bullet structure.

12. The structure defined in claim 9, wherein each of said sabot segments extends rearwardly approximately 0.045 inches further than the rear end of said bullet structure.

13. A sabot bullet to be employed within a shotgun shell for use with a firearm, comprising:

(a) a relatively rigid generally cylindrical bullet structure having a generally circumferential outer surface with a radially constricted middle portion, a forward portion and a rear portion, said outer circumferential surface of at least a part of said forward and rear portions diverging radially outward from said constricted middle portion toward respective forward and rear ends thereof;

(b) a sabot means substantially surrounding at least an intermediate portion of said bullet structure between said opposite forward and rear ends thereof to form an outer housing for guiding said bullet structure through the barrel of the firearm, said sabot means being disposed in drivable engagement with said bullet structure; and (c) said sabot means comprising a plurality of sabot segments having complimentary diverging forward and rear inner surface portions which substantially conform to said forward and rear diverging surfaces of said bullet structure, each of said sabot segments extending rearwardly beyond and being devoid of contact with said rear end of said bullet structure, thereby defining an open recess adjacent said rear end of said bullet structure which provides means for facilitating rearward movement of said bullet structure relative to said sabot means upon firing of the firearm.

14. The structure defined in claim 13, wherein said radially diverging outer circumferential surface of said forward position of said bullet structure diverges at an angle slightly greater than said complimentary diverging forward inner surface portion of each of said sabot segments.

15. The structure defined in claim 13, wherein said inner surface portions of each of said sabot segments is radially spaced from said outer circumferential surface of said bullet structure at a point immediately adjacent to said radially constricted middle portion thereof, said complimentary diverging forward inner surface portions of each of said sabot segments converging with said radially diverging outer circumferential surface of said forward position of said bullet structure at a point adjacent said front end thereof.

16. The structure defined in claim 13, wherein said inner conforming surface of each of said sabot segments is slightly radially spaced from said outer circumferential surface of said bullet structure at a point adjacent said constricted middle portion thereof, said inner conforming surface of each said sabot segments diverging outwardly therefrom and drivably engaging said bullet structure in guiding relation near said forward end thereof.

17. The structure defined in claim 13, wherein said diverging forward inner surface portions of each of said sabot segments is disposed at a slight angle relative to said diverging forward portions of said bullet structure which it compliments so as to drivably engage said bullet structure in guiding relation mainly at a point adjacent said forward end thereof upon firing of the firearm.

18. The structure defined in claim 13, wherein the forwardmost and rearmost portion of said bullet structure are cylindrical in shape, and a portion of said diverging forward inner surface of each of said sabot segments is radially spaced annularly about a major portion of said diverging forward portions of said bullet structure which it compliments, so as to drivably engage said bullet structure in guiding relation mainly at a point near the forwardmost point of said forward diverging portion of said bullet structure.

19. The structure defined in claim 13, wherein each of said sabot segments extend rearwardly beyond said rear end of said bullet structure approximately 0.045 inches.

* * * * *

UNITED STATES PATENT AND TRADEMARK OFFICE

CERTIFICATE OF CORRECTION

PATENT NO. : 5,175,389

DATED : Dec. 29, 1992

INVENTOR(S) : Kramer et al.

It is certified that error appears in the above-identified patent and that said Letters Patent is hereby corrected as shown below:

Column 8, line 3, change "lest" to --least--.

Column 9, line 7, cancel "position" and substitute therefor --portion--.

Signed and Sealed this

Eighth Day of March, 1994

Bruce Lehman

*Attest:*

BRUCE LEHMAN

*Attesting Officer*

*Commissioner of Patents and Trademarks*